United States Patent [19]

Nauheimer

[11] Patent Number: 5,033,191

[45] Date of Patent: Jul. 23, 1991

[54] DISPOSABLE RAZOR

[75] Inventor: Vincent J. Nauheimer, Croton-on-Hudson, N.Y.

[73] Assignee: Irad, Inc., Arlington Heights, Ill.

[21] Appl. No.: 333,123

[22] Filed: Apr. 4, 1989

[51] Int. Cl.[5] ..... B26B 21/00

[52] U.S. Cl. ..... 30/47; 30/85

[58] Field of Search ..... 30/47, 50, 85

[56] References Cited

U.S. PATENT DOCUMENTS

| | | | |
|---|---|---|---|
| 1,875,990 | 9/1932 | Christmas . | |
| 1,975,365 | 10/1934 | Levitt et al. | 30/12 |
| 1,985,132 | 12/1934 | Woods | 30/12 |
| 1,991,290 | 2/1935 | McGirp et al. | 30/12 |
| 2,075,007 | 3/1937 | Christmas | 30/47 |
| 2,445,528 | 7/1948 | Keogh, Jr. | 30/41 |
| 2,589,327 | 3/1952 | Biggs | 30/47 |
| 2,694,857 | 11/1954 | Koval | 30/47 |
| 2,699,602 | 1/1955 | Finley | 30/47 |
| 2,716,810 | 9/1955 | Koval | 30/47 |
| 2,729,887 | 1/1956 | Appeldorn | 30/41 |
| 2,871,560 | 2/1959 | Eberbaugh | 30/47 |
| 3,367,482 | 2/1968 | Samsing | 206/16 |
| 3,492,723 | 2/1970 | Mollica et al. | 30/47 |
| 3,750,280 | 8/1973 | LePaliscot et al. | 30/85 |
| 4,439,920 | 4/1984 | Nauheimer | 30/47 |
| 4,485,554 | 12/1984 | Bergamaschi | 30/50 |
| 4,554,735 | 11/1985 | Chen | 30/47 |
| 4,712,301 | 12/1987 | Saito | 30/47 |

FOREIGN PATENT DOCUMENTS

| | | | |
|---|---|---|---|
| 1562173 | 3/1980 | United Kingdom | 21/52 |

*Primary Examiner*—Timothy V. Eley
*Assistant Examiner*—Willmon Fridie
*Attorney, Agent, or Firm*—Olson & Hierl

[57] ABSTRACT

A relatively inexpensible, disposable and foldable razor comprises a single, die-cut sheet of material that includes a series of unique folds which define a handle portion, a blade holding portion and a blade supporting portion which receive and hold a blade in a stationary position during use. The device is compact and foldable for efficient storage.

12 Claims, 4 Drawing Sheets

DISPOSABLE RAZOR

FIELD OF THE INVENTION

The present invention relates to shaving instruments and in particular to a relatively inexpensive, foldable and disposable razor.

BACKGROUND OF THE INVENTION

Disposable safety razors have been available for some time. The most commercially successful disposable razors are plastic, injection-molded devices. While such disposable razors generally provide satisfactory shaving performance, these devices do include several disadvantages. For example, the design of each razor is relatively complex and includes several interlocking pieces such as the handle, razor head and blade guard, which must be molded separately and assembled along with a blade. This adds to the expense of the product. In addition, the injection molding process itself has several drawbacks.

The equipment needed for injection molding is quite costly and requires a considerable degree of upkeep and maintenance. This is particularly true when considering the small tolerances needed to efficiently mass produce an injection-molded razor. In addition, the process of injecting and hardening a plastic in a mold takes time, and production is limited further by the number and complexity of the molds. Finally, post-injection molding processes including trimming, flashing and degating add further time constraints and expense to the manufacturing process.

In addition to the disadvantages of injection molding, currently available disposable razors are no more compact for efficient storage during shipping and travel than standard, reusable safety razors.

One method of making disposable razors more compact for storage has been the design of foldable or "match book"-type razors. Despite numerous attempts to design such a "match book" disposable razor, each such design has been flawed to the extent that no design has achieved any notable commercial success.

The flaws of these "match book"-type disposable razors generally fall into two categories. Many of these devices are simply too pliable to maintain the precise shaving head angle needed for safe use. In an effort to provide the proper shaving head angle, many of these devices add a degree of complexity which includes the introduction of several parts and even resort to the use of injection molded components as supporting means. Of course, these measures add considerably to the cost of the product.

In addition, adhering the blade in a stationary position so it will not shift during use is a problem. In many of these devices, this is accomplished through use of a separate, external connecting means such as staples or pins. Again, such additional components can add considerably to the cost of such devices.

Thus, a need exists for a "match book"-type disposable razor which provides the necessary blade adherence and stability of the blade head angle to ensure a safe shave while avoiding costly production steps such as injection molding or the combination of multiple of parts.

SUMMARY OF THE INVENTION

The present invention comprises a disposable razor formed from a single, die-cut sheet of material. The design eliminates the use of molded parts which is an inherent part of the manufacture of all commercially successful disposable razors. This is accomplished by providing a series of unique folds in the sheet of material along a series of score lines which define a handle portion, a blade holding portion and a blade supporting portion adapted to hold a razor blade.

The handle portion comprises a rear wall and a pair of side walls disposed on each side of the rear wall. In a preferred embodiment, the rear wall is substantially rectangular and the side walls are trapezoidal in shape.

The blade holding portion includes a first blade holding panel having at least one tab extending therefrom and a second blade holding panel foldably connected to the first blade holding panel.

The blade supporting portion comprises a rear supporting wall associated with the rear wall of the handle portion, a pair of side walls disposed on each side of the rear wall of the blade supporting portion and associated with the side walls of the handle portion. In a preferred embodiment, the rear wall of the blade supporting portion is generally triangular and trapezoidal shaped and the side walls are generally triangular. A generally rectangular intermediate panel section is disposed between the rear wall of the blade supporting portion, and first and second generally rectangular blade holding panels disposed above the intermediate panel.

The second blade holding panel of the blade holding portion includes an aperture which can receive the tab of the first blade holding panel. Limited assembly includes adding a blade between the first and second blade holding panels and folding the first blade holding panel against and securing it to the second blade holding panel such that the edge of the blade extends through the aperture. The tab extending from the proximal end of the first blade holding panel is secured to the intermediate panel so that the intermediate panel and the assembled blade holding portion are disposed generally perpendicularly from each other.

The present invention thus provides the necessary blade adherence and blade head angle stability for a safe shave. This stability is achieved without the use of costly injection molding or the addition of a plurality of parts.

BRIEF DESCRIPTION OF THE DRAWINGS

FIGS. 7A and 7B through FIGS. 11A, 11B and 11C are alternative embodiments of the invention.

DETAILED DESCRIPTION OF THE INVENTION

Figure 1:
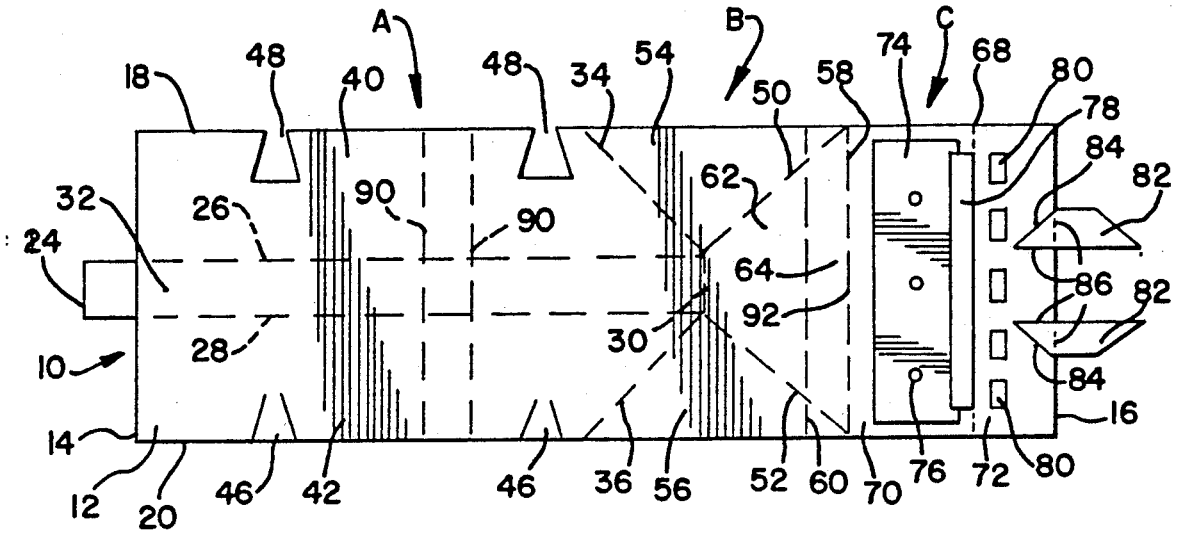
FIG. 1 is a top view of the pattern or "blank" of a preferred embodiment according to the present invention.

Referring to FIG. 1, a "blank" of a preferred embodiment of a device according to the present invention is shown after die cutting and scoring and prior to limited assembly. Because the present invention features a unitary construction free of add-on parts, with the exception of the blade, the blank of the present device is designated, as is the completed disposable razor, by the reference numeral 10.

The blank 10 comprises a generally rectangular sheet of low cost material 12 that is foldable, but rigid, and is moisture resistant. Representative materials include plastic, treated cardboard, treated paper and similar materials.

The generally rectangular sheet includes a distal edge 14, a proximal edge 16 and two elongated edges 18 and 20. The generally rectangular sheet 12 shown in FIG. 1 also includes a series of cuts designated by solid lines, temporary folds designated by dashed lines, permanent folds designated by dotted lines and a recessed area designated by a shaded portion.

Extending from the distal edge 14 of the generally rectangular sheet 12 is a tab 24 which secures the assembled disposable razor 10 in the closed or "match book" position, as will be explained in greater detail.

Extending longitudinally from the tab 24 are two substantially parallel score lines 26 and 28. A relatively short, upper transverse score line 30 connects the proximal ends of the two substantially parallel score lines 26 and 28. The upper transverse score line 30 along with the substantially parallel score lines 26 and 28 define a generally rectangular rear wall 32 of a handle portion A.

Extending from the junction of the substantially parallel score lines 26 and 28 and the upper transverse score line 30 are a pair of mirrored score lines 34 and 36 which are angled distally towards the elongated edges 18 and 20 of the generally rectangular sheet 12.

The substantially parallel score lines 26 and 28 and the two mirrored distally angled score lines 34 and 36 define two trapezoidal side walls 40 and 42 of the handle portion. Thus, the rear wall 32 and the side walls 40 and 42 form the handle portion of the razor.

The handle portion can include means for securing the side walls 40 and 42 together. In the disclosed embodiment, this securing means includes a pair of generally triangular tabs 46 extending from one side wall 42 and corresponding generally triangular tab cut-outs 48 on the second side wall 40 of the handle portion. When the device is assembled, the side walls 40 and 42 are rotated together about the substantially parallel longitudinal score lines 26 and 28, as is discussed in more detail below. When so rotated, the tabs 46 can be inserted into the cut-outs 48 to form the handle portion.

Also extending from the junction of the two substantially parallel longitudinal score lines 26 and 28 and the upper transverse score line 30 are a pair of mirrored score lines 50 and 52 which are angled proximally towards the elongated edges 18 and 20 of the generally rectangular sheet 12. With the distally angled score lines 34 and 36 and the upper transverse score line 30, the proximally angled score lines 50 and 52 generally form an "X" configuration. This configuration defines three generally triangular sections including two side walls 54 and 56 of a blade supporting portion B.

Extending from the junctions of the two proximally angled score lines 50 and 52 and the respective elongated edges 18 and 20 of the rectangular sheet 12 is a transverse score line 58. Extending across the two proximally angled score lines 50 and 52 generally parallel to the transverse score line 58 is a second, transverse score line 60. The second, transverse score line 60 along with the two proximally angled score lines 50 and 52 and the upper transverse score line 30 forms a trapezoidal rear wall 62 of the blade supporting portion which is generally triangular in shape and defines the third of the generally triangular sections formed by the "X" configuration.

The two transverse score lines 58 and 60 together form an intermediate panel 64 of the blade supporting portion which, while generally rectangular in shape, is also crossed by the two proximally angled score line 50 and 52. The panel 64 along with the rear wall 62 and the two side walls 54 and 56 comprise the blade supporting portion.

An additional transverse score line 68 divides the remaining proximal portion of the blank 10 into a first, generally rectangular blade holding panel 70 and a second, generally rectangular blade holding panel 72, which together form a blade holding portion C of the razor.

The first blade holding panel 70 includes a recessed area 74 stamped into the blank 10 which serves as a guide for the proper placement of the blade. Included in the recessed area 74 is at least one raised extension 76 which can be formed by not depressing that portion of the blank. These extensions 76 correspond to preformed openings defined in the blade which in conventional practice are typically secured by expensive, separately molded pins, thus providing blade stability without this added expense.

The first blade holding panel 70 also defines a blade aperture 78 while the second blade holding panel 72 defines a plurality of smaller openings 80 proximal to the blade aperture 78. When a blade is positioned in the recessed area 74 of the first blade holding panel 70 and the second blade holding panel 72 is folded and secured under the blade, the edge of the blade can extend through the blade aperture 78 while the smaller openings 80 are disposed below the blade to provide for egress of water and shaving cream.

Also provided on the second blade holding panel 72 along the proximal edge 16 of the blank are two tabs 82. Each tab 82 includes a die-cut line 84 extending into the second blade holding panel 72 and two generally perpendicular score lines 86 which thereby define the trapezoidal shape of the tab 82.

The trapezoidal tabs 82 when properly secured to the intermediate panel 64 ensure the precise shaving angle of the blade. At the same time, the tabs 82 maintain the angle rigid enough for shaving and allow the blank to be formed from a single die-cut sheet.

Figure 3:
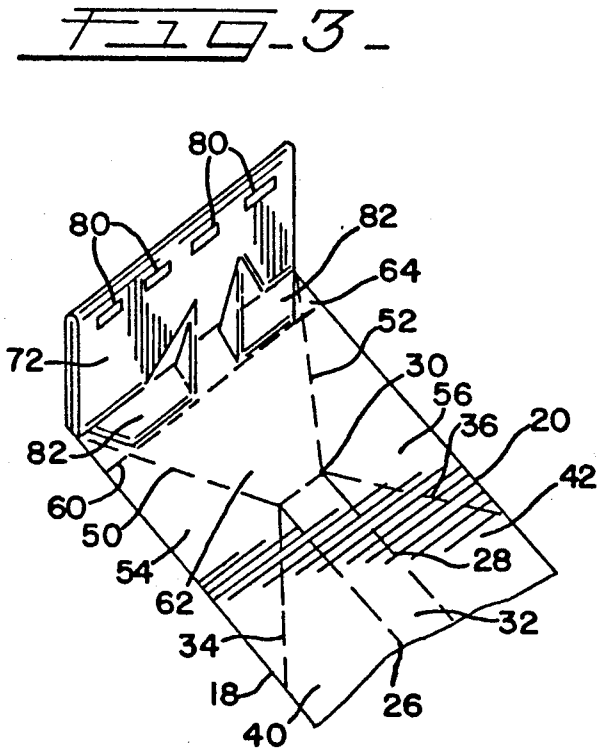
FIG. 3 is a partial, perspective view of the assembled blade head of the device of FIG. 1.

Specifically, the angles of the trapezoidal tabs fold out on the intermediate panel 64 to meet the corners, thereby providing maximum adhesion space. At the same time, the tabs do not interfere with the forming of the handle defined by score line 36, score line 52 and score line 28 and corresponding score lines 34, 50 and 26, respectively. FIG. 3 demonstrates the foregoing. These two trapezoidal tabs 82 when properly folded, form braces that hold the head rigid at the proper angle. This is one feature that distinguishes the present razor from the devices of the prior art. Until now, all the shaving head angles have had to be either molded or formed by adding an additional part.

Figure 2:
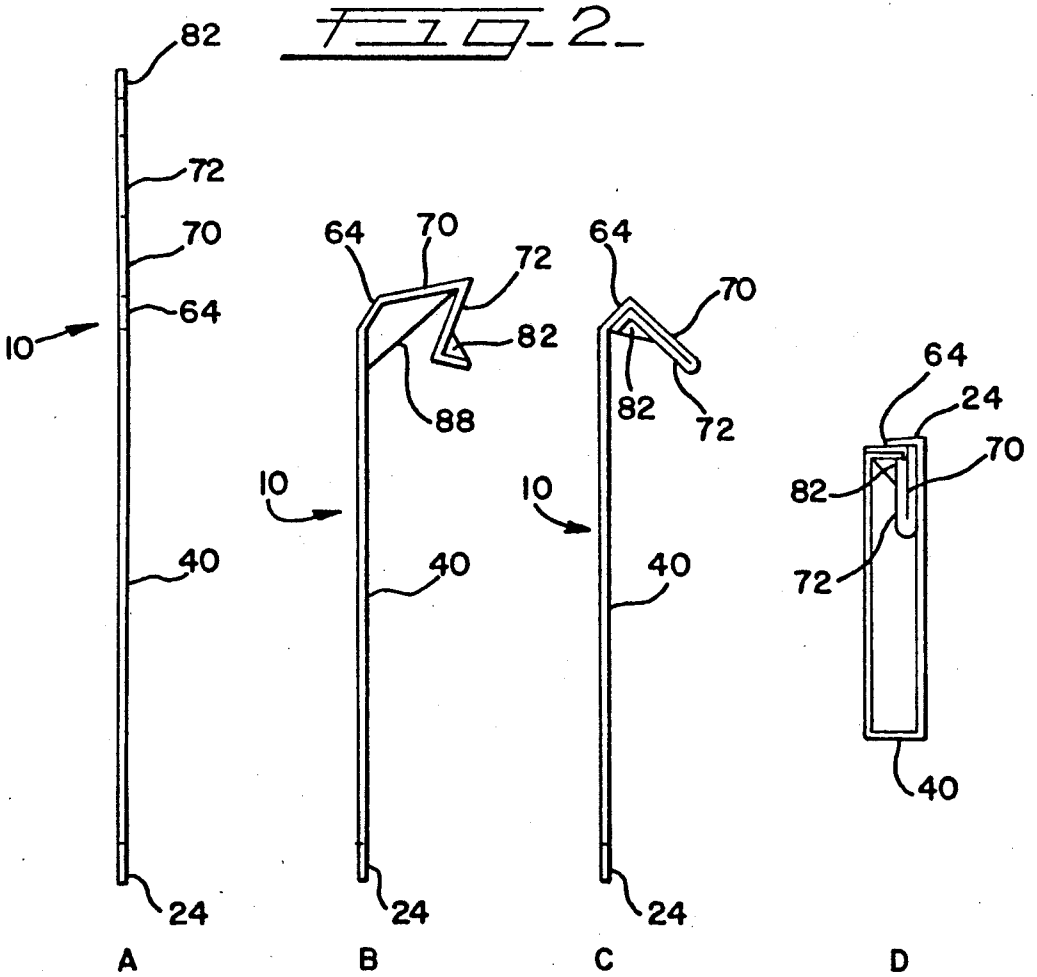
FIGS. 2A–2D are side elevational views of the device of FIG. 1 in various stages of assembly.

Referring now to FIG. 2, the necessary limited assembly is described. As is shown in FIG. 2A, the completed die-cut, scored blank comprises a single, unitary sheet of material with no additional pieces.

To assemble the device, the trapezoidal tabs 82 extending from the proximal edge 16 of the blank are folded along the score lines 86 so that the tabs 82 extend generally perpendicularly from the secured blade holding panel 72, as is shown in FIG. 2B.

A blade 88 is provided disposed between the first and second blade holding panels 70 and 72 positioned in the recessed area 74 of the first blade holding panel 70. The blade 88 can also include disposed etherebelow comb fingers (not shown) which work in conjunction with the plurality of smaller openings 80 to provide water and shaving cream egress. The second blade holding panel 72 is then folded against the first blade holding panel 70 and the two are secured together. The trapezoidal tab 82 is then secured to the intermediate panel 64, as is shown in FIG. 2C and FIG. 3.

To provide the "match book" package for shipping or travel, the blank is further folded about at least one auxiliary score line 90 (see, for example, FIG. 1) provided across the rear wall 32 of the handle portion and the side walls 40 and 42; then the generally square tab 24 is inserted into an opening 92 (see FIG. 1) provided in the intermediate panel 64 between the secured trapezoidal tabs 82. In this "match book" position the present device can be compactly stored and is particularly appropriate for shipping or travel (FIG. 2D).

Figure 4:
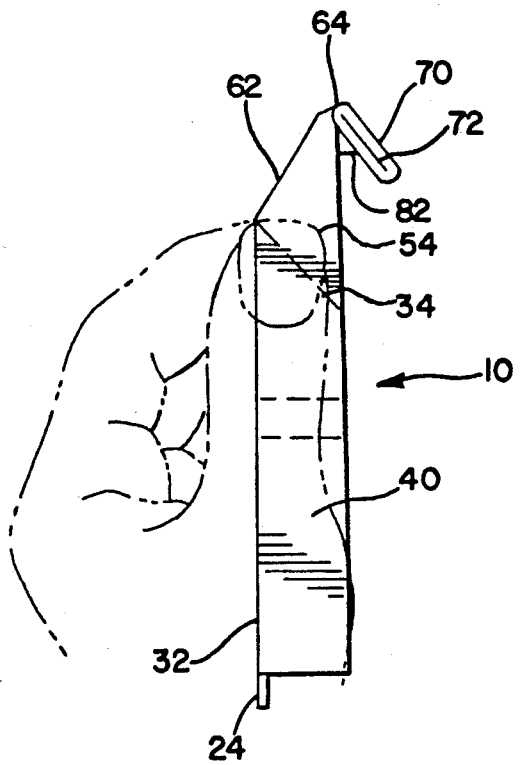
FIG. 4 is a side elevational view of the assembled device of FIG. 1.
Figure 5:
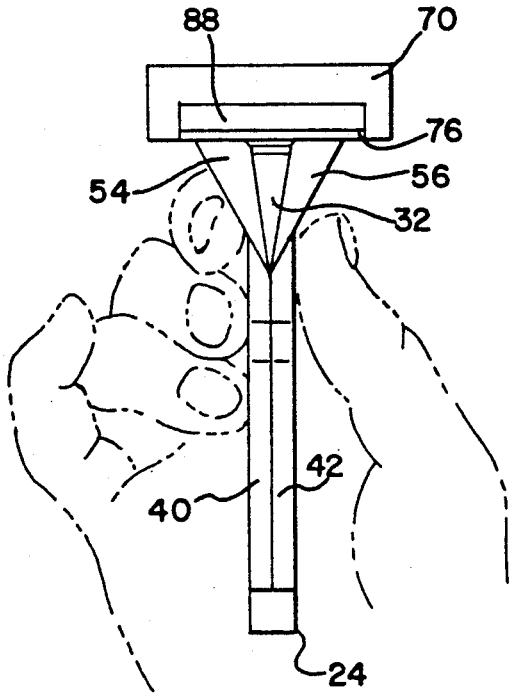
FIG. 5 is a front elevational view of the assembled device of FIG. 1.

For use, the device is returned to the non-"match book" position shown in FIG. 2C, and the side walls 40 and 42 of the handle portion are rotated around the generally parallel longitudinal score lines 26 and 28. This is preferably accomplished by grasping the device 10 between the thumb and the fingers, with this grip securing the device 10 in the use position, as is seen in FIGS. 4 and 5.

Figure 6:
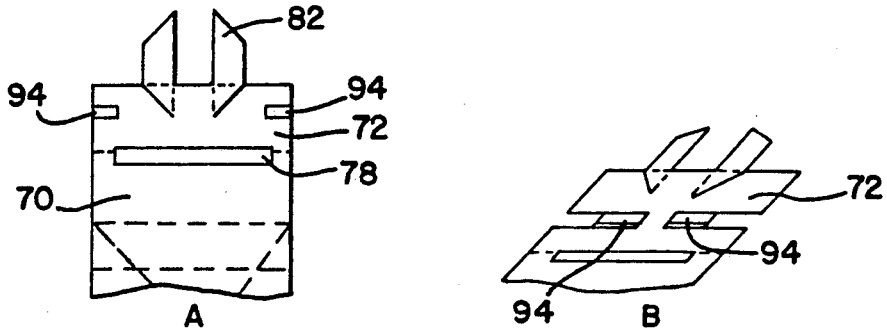
FIGS. 6A and 6B are top and perspective views, respectively, of an alternative embodiment.
Figure 7:
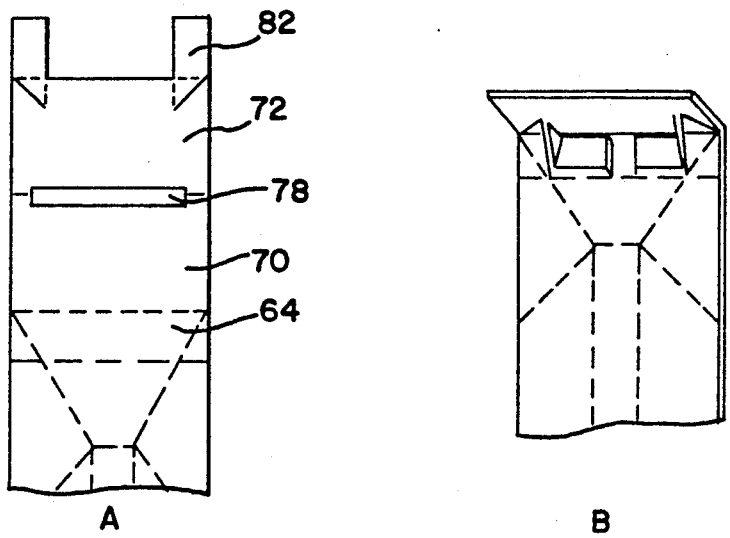
Figure 8:
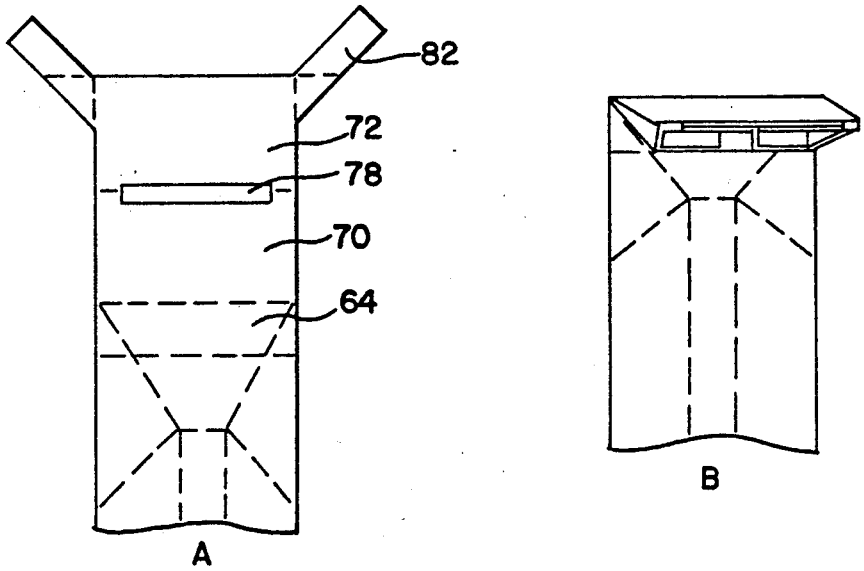
Figure 9:
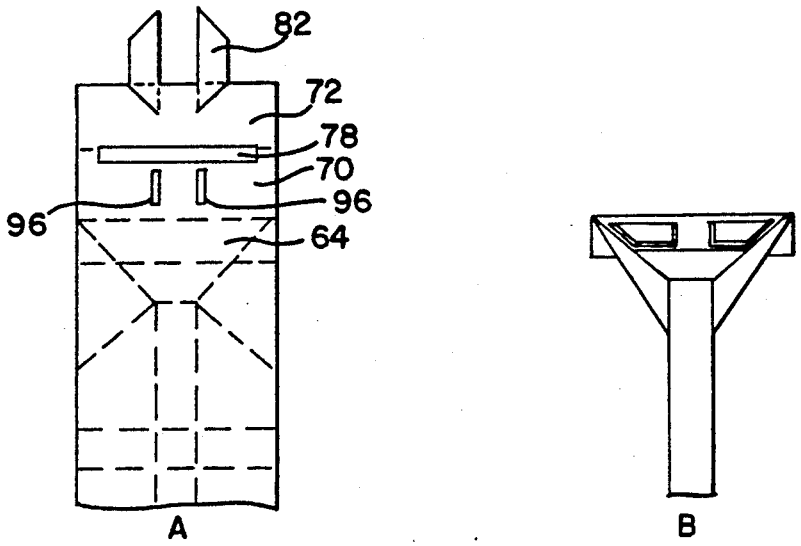
Figure 10:
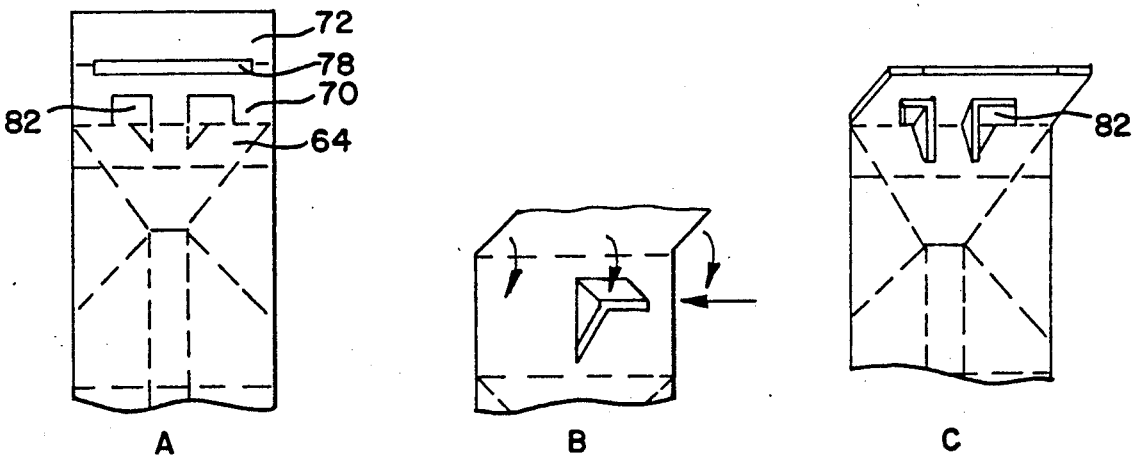
Figure 11:
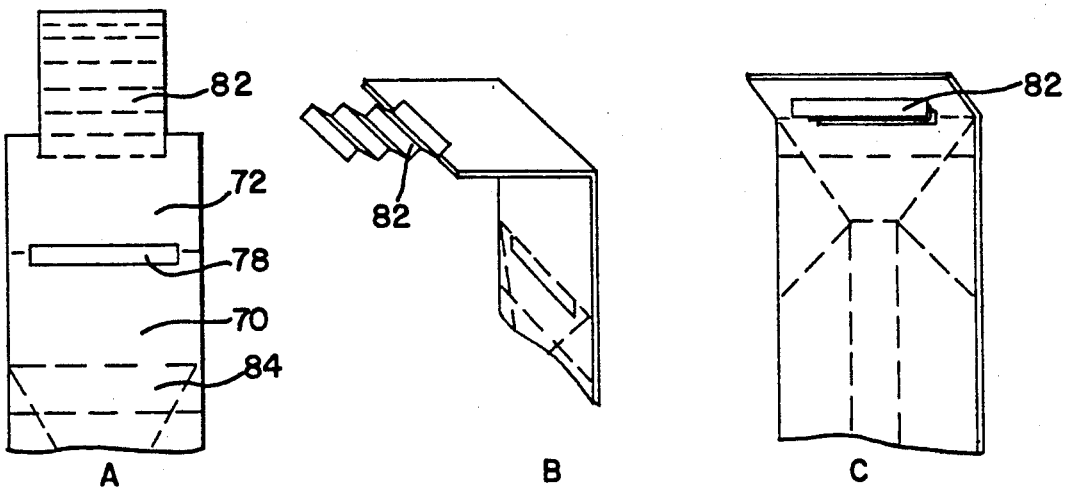

Referring to FIG. 6, an alternative embodiment of the present invention is shown with a pair of die-cut extensions 94 in the second blade holding panel 72 for holding the blade 88 in a stationary position. The extensions 94 can be used in lieu of or in addition to the extensions 76 and are folded over to engage a surface of the blade. The purpose of the extensions 94 is to raise the blade to allow for the twin blades. Placement of the extensions grab the first blade and allow the separation and placement of a second blade (not shown).

FIG. 7–11 show additional embodiments for the tabs 82. In particular, FIGS. 7A and 7B show tabs 82 extending from the end portions of the proximal edge 16 of the second blade holding panel 72 rather than as shown in FIG. 1. This orientation provides an additional way the tabs may be folded depending on the packaging machinery used. FIGS. 8A and 8B show another embodiment wherein the tabs 82 extend at an angle from the proximal edge 16 of the second blade holding panel 72. In this manner, the support for the razor is shifted from the middle of the razor to the outside portions of the razor head. These tabs 82 can also extend from the proximal edge of edges 18 and 20 on the first blade holding panel 70. The purpose of this configuration is to provide a wrap around construction and add strength to the permanent angle of the shaving head. Thus, it can be seen that various alternative constructions are possible.

FIGS. 9A and 9B show tabs 82 extending from the proximal edge 16 of the second blade holding portion as in FIG. 1, but further including slots 96 defined in the first blade holding panel 70 adapted to receive the tabs 82, in this manner, the tabs 82 can extend through the appropriate openings in the blade 88 and the slots 96 to firmly secure the blade in a stationary position.

FIGS. 10A, 10B and 10C show a further embodiment wherein the tabs 82 are formed in the first blade holding panel 70 and can be folded as shown in FIGS. 10B and 10C to support the blade. The tabs are pushed upwardly from beneath the blank by pins associated with the packaging machinery to form a shelf upon which the razor head can be positioned and glued.

FIGS. 11A, 11B and 11C show an additional embodiment having a pleated tab 82 which can be folded, compressed and glued to form a block-like support for the blade. A sliding jig compresses a portion of the blank to form the pleated tab. This further provides for the proper shaving angle of the blade and eliminates the use of fingers and pins in the packaging machinery.

By forming the razor from a single die-cut sheet, the sheet can be printed before cutting. As a result, the individual blanks cut from the sheet can be labelled prior to manufacture. Currently, all molded plastic razors must be individually handled and labelled after manufacturing by either hot stamping, adhesive labels or etching. As is evident, the cost savings can be considerable. However, cost savings is only one advantage of using a preprinted sheet. Another advantage is that it allows for the use of multicolor screened graphics of any type. This is a new development in the razor business and provides new opportunities for use of the device both as a premium item and as a privately labelled product.

It should be understood that various modifications, changes, and variations in addition to those herein discussed may be made in the arrangement, operation and details of construction and assembly of the elements disclosed herein without departing from the spirit and scope of the invention.

What is claimed is:

1. A disposable, foldable razor comprising:

a handle portion, a blade holding portion, a blade supporting portion and a blade;

the handle portion including a rear wall having a pair of elongated sides and a pair of side walls extending from and foldably connected to the elongated side of the rear wall;

the blade holding portion including a first blade holding panel having at least one tab extending therefrom and a second blade holding panel foldably connected to the first blade holding panel, the second blade holding panel defining an aperture such that when the blade is placed between the first and second blade holding panels and the first and second blade holding panels are folded together, the blade can extend through the aperture;

the blade supporting portion including a rear wall extending from and foldably connected to the rear wall of the handle, a pair of side walls extending from and foldably connected to each side of the rear wall of the blade supporting portion and to the side walls of the handle portion, and an intermediate panel foldably connected to the rear wall of the blade supporting portion and the second blade holding panel;

whereby the intermediate panel and the first and second blade holding panels can be folded to secure the blade in a stationary position.

2. The disposable, foldable razor of claim 1 wherein the first blade holding panel further includes a plurality of openings.

3. The disposable, foldable razor of claim 2 wherein the second blade holding panel further includes a recessed section adapted to receive the blade.

4. The disposable, foldable razor of claim 3 wherein the blade includes a plurality of openings which correspond to the opening of the first blade holding panel and the recessed section further includes at least one extension that corresponds to the openings defined by the blade and the first blade holding panel.

5. The disposable, foldable razor cf claim 1 wherein the side walls of the handle portion further include means for securing the side walls together.

6. The disposable, foldable razor of claim 5 wherein the securing means includes at least one tab disposed on one side wall of the handle portion and a corresponding cut-out portion disposed on the second side wall of the handle portion.

7. A disposable, foldable razor comprising a generally rectangular sheet of material including a distal edge, a proximal edge and two elongated edges, the sheet of material including:

(a) a pair of generally parallel, longitudinal score lines having upper ends and extending from the distal edge and a transverse score line disposed between the upper ends of the longitudinal score lines, the longitudinal score lines and the transverse score line defining a rear wall of the handle portion;

(b) a pair of mirrored, angled score lines extending distally from the junction of the transverse score line and the longitudinal score lines to the elongated edges of the generally rectangular sheet of material, the distally angled score lines defining with the longitudinal score lines a pair of side walls of the handle portion, the pair of side walls and the rear wall together defining the handle portion;

(c) a second pair of mirrored, angled score lines extending proximally from the junction of the transverse score line and the longitudinal score lines to the elongated edges of the sheet of material, the distally and proximally angled score lines together defining a pair of side walls of a blade supporting portion;

(d) a pair of generally parallel transverse score lines with the proximal transverse score line of the pair extending from the junction of each of the proximally angled score lines and the elongated edges of the generally rectangular sheet of material, the pair of generally parallel transverse score lines defining an intermediate panel and the distal transverse score line defining with the proximally angled score lines a generally triangular, trapezoidal rear wall of the blade supporting portion, the side walls of the blade supporting portion, the rear wall of the blade supporting portion and the intermediate panel defining the blade supporting portion; and (e) an additional transverse score line dividing the remaining material into first and second generally rectangular blade holding panels with the first blade holding panel being disposed adjacent to the intermediate panel and defining an aperture, the second blade holding panel including at least one tab extending from the proximal edge of the sheet of material, the first and second blade holding panels defining a blade holding portion;

whereby when a blade is placed between the first and second blade holding panels, the second blade holding panel is folded against the first blade holding panel and the tab is secured to the intermediate panel, the blade can extend through the aperture and is held in a stationary position.

8. The disposable, foldable razor of claim 7 wherein the first blade holding panel includes a plurality of openings.

9. The disposable, foldable razor of claim 8 wherein the second blade holding panel includes a recessed section adapted to receive the blade.

10. The disposable, foldable razor of claim 9 wherein the blade includes a plurality of openings which correspond to the openings of the first blade holding panel and the recessed section further includes at least one extension that corresponds to the openings defined by the blade and the first blade holding panel.

11. The disposable, foldable razor of claim 7 wherein the side walls of the handle portion further include means for securing the side walls together.

12. The disposable, foldable razor of claim 11 wherein the securing means includes at least one tab disposed on one side wall of the handle portion and a corresponding cut-out portion disposed on the second side wall of the handle portion.

* * * * *